US006979097B2

(12) United States Patent
Elam et al.

(10) Patent No.: US 6,979,097 B2
(45) Date of Patent: Dec. 27, 2005

(54) MODULAR AMBIENT LIGHTING SYSTEM

(76) Inventors: Thomas E. Elam, 612 Broadwalk Ave., Southlake, TX (US) 76092; Timothy P. Scherf, 1748 N. Modoc St., Orange, CA (US) 92867

( * ) Notice: Subject to any disclaimer, the term of this patent is extended or adjusted under 35 U.S.C. 154(b) by 89 days.

(21) Appl. No.: 10/391,164

(22) Filed: Mar. 18, 2003

(65) Prior Publication Data

US 2004/0184264 A1 Sep. 23, 2004

(51) Int. Cl.[7] ..... F21S 1/02
(52) U.S. Cl. ..... 362/148; 362/407; 362/404; 362/646; 362/648
(58) Field of Search ..... 362/147, 148, 362/150, 226, 404, 368, 217, 225, 646, 648, 362/407

(56) References Cited

U.S. PATENT DOCUMENTS

| | | | | |
|---|---|---|---|---|
| 2,988,633 A | | 6/1961 | Rosenfield | |
| 3,375,322 A | | 3/1968 | Seria et al. | |
| 3,409,262 A | | 11/1968 | Soule | |
| 4,146,287 A | | 3/1979 | Jonsson | |
| 4,186,433 A | | 1/1980 | Baldwin | |
| 4,280,170 A | | 7/1981 | Baldwin | |
| 4,286,313 A | * | 8/1981 | Quiogue | 362/370 |
| 4,504,891 A | | 3/1985 | Mazis | |
| 4,651,059 A | | 3/1987 | Nilssen | |
| 5,105,346 A | | 4/1992 | Aks et al. | |
| 5,111,370 A | | 5/1992 | Clark | |
| 5,132,884 A | | 7/1992 | Totten | |
| 5,174,642 A | | 12/1992 | Brohard et al. | |
| 5,408,394 A | * | 4/1995 | Mandy | 362/148 |
| 5,581,448 A | * | 12/1996 | Harwood | 362/147 |
| 5,931,556 A | | 8/1999 | Herst et al. | |
| 6,186,642 B1 | | 2/2001 | Corcorran et al. | |
| 6,260,981 B1 | * | 7/2001 | Fiene | 362/147 |
| 6,305,816 B1 | | 10/2001 | Corcorran et al. | |
| 6,413,107 B1 | | 7/2002 | Neuhorst et al. | |
| 6,439,736 B1 | | 8/2002 | Fiene | |
| 6,733,158 B2 | * | 5/2004 | Fischer et al. | 362/404 |
| 2002/0001191 A1 | | 1/2002 | Grierson et al. | |

FOREIGN PATENT DOCUMENTS

| | | | | |
|---|---|---|---|---|
| WO | WO03027570 | * | 4/2003 | 362/147 |

OTHER PUBLICATIONS

Ergolight: Intelligent Lighting/Energy Management—Specifications and Information Brochure, Ledalite (2002).
MesoOptics: Advanced Optical Control Technology, Ledalite.

* cited by examiner

*Primary Examiner*—Stephen Husar
*Assistant Examiner*—Anabel Ton
(74) *Attorney, Agent, or Firm*—D. Scott Hemingway; Malcolm W. Pipes; Hemingway & Hansen, LLP

(57) ABSTRACT

The invention is a modular ambient lighting system for providing lighting to the interior of the building. The system features three separate modules: (1) a support module, (2) a power module, and (3) a light fixture body module. The support module provides an electrical connection to the building and structural connection to the ceiling of the building. An interchangeable power module fits into a recess or "foot print" in the support module. The power module includes the electrical components of the lighting system (e.g. ballast, transformer, emergency batteries, etc). An interchangeable light fixture body module houses the lamp that can be configured to deliver direct, indirect, or direct/indirect illumination. The interchangeable features of the modules offers superior flexibility because of the ease to reconfigure the electrical operation of the light system, the type illumination delivered, or the aesthetics of the light system.

27 Claims, 11 Drawing Sheets

MODULAR AMBIENT LIGHTING SYSTEM

TECHNICAL FIELD OF THE INVENTION

A lighting system for building interiors.

BACKGROUND OF THE INVENTION

Office and other in-door work environments require artificial lighting to supply interior illumination. Interior illumination falls into three main classes: (1) direct lighting, (2) indirect lighting, and (3) a combination referred to as direct/indirect lighting. "Direct" is illumination directed below the horizontal plane. "Indirect" is illumination directed above the horizontal plane. "Direct/indirect" is illumination directed above and below a horizontal plane.

A common, prevalent, older direct lighting system in current use is a recessed lensed troffer or parabolic unit. Representative recessed troffer lighting systems are disclosed by U.S. Pat. No. 4,504,891 to Mazis and U.S. Pat. No. 4,146,287 to Jonsson.

While these direct lighting systems provide acceptable lighting in many work environments, the lighting provided in business environments utilizing computer systems is not wholly satisfactory. Employees working with computer screens often complain of glare on their screens from improper direct lighting levels and locations. Another complaint arising from direct lighting is a cave-like feeling for employees and customers created by dark upper walls and ceiling areas. Another complaint about direct lighting is improper contrast ratios between highly reflective surfaces (e.g. paper) that are bright and dark computer screens, walls, or ceilings. Shadows created by objects blocking direct light illumination are also a common problem.

Building owners also often complain of high-energy consumption, high maintenance costs, and difficulty in properly positioning direct lighting systems to accommodate the individual needs of employees. For example, an industry standard for 2-foot by 4-foot recessed parabolic systems is one unit used to illuminate 80 square feet of floor space, which requires 110 watts of electricity. A 20,000 square foot facility with 160 employees would use 250 recessed parabolic units requiring 27,500 watts of electricity.

In recent years, linear indirect or direct/indirect systems became an alternative lighting option to direct lighting systems. These linear indirect systems used pre-wired sections of lighting devices shipped to the building site and assembled section-by-section to form continuous rows of light fixtures suspended from the ceiling into the workspace below. These suspended light systems directed light to the bottom of the ceiling surface to reflect light to the area below. An example of a linear indirect light system is disclosed by U.S. Pat. No. 6,305,816 B1 to Corcarran et al. The reflected light from this type of linear indirect system decreased employee complaints associated with direct lighting systems (e.g. less glare on computer screens), and studies from various universities and private corporations showed these linear indirect lighting systems increased productivity of employees and lowered energy consumption by allowing reduced lighting levels to adequately illuminate an office work environment.

Over time, the linear indirect light systems became less expensive to manufacture, and as installers gained installation experience with these systems, installation costs fell resulting in lower initial purchase costs. Eventually, these costs began approaching a comparable level to the installation costs for common recessed direct lighting systems.

Although most lighting complaints involving computers were resolved or diminished by these systems, these linear indirect lighting systems have proven to be less flexible compared to recessed direct lighting systems.

For example, changes in floor plans are very hard to implement with linear indirect systems. Additional parts or section lengths for linear indirect systems usually must be purchased, and vendors' frequent changes in manufacturing and designs make paint finishes and component part matching very difficult to accomplish. Moreover, structural supports and electrical connections must be relocated inside the building structure when internal walls are erected or moved, which requires additional time and labor. Often, this relocation work is an inconvenience to workers because the relocation must be undertaken while the workspace is in use, which interrupts employees and disrupts the work environment. In recent years, the popularity of these linear indirect lighting systems has decreased as decision-makers recognized the inherent inflexibility of the basic design despite the overall improvement in illumination quality for work areas.

A third lighting system option has evolved featuring recessed indirect lighting. Generally, these systems use a 2-foot by 2-foot ceiling recessed housing installed in a similar fashion as previous direct lighting systems. Lighting is directed upward into the housing and a reflector directs illumination into the space below. Building structure changes (e.g. new or moved walls) are much easier and simpler to implement with these recessed indirect systems compared to linear indirect systems, but visual quality is only slightly improved compared to earlier direct lighting systems. The clear advantage of these newer recessed indirect lighting systems over the earlier systems is increased flexibility. However, screen glare, shadows, mismatched contrast ratios, and high energy consumption remain as undesired attributes of a recessed indirect lighting system because of inflexibilities associated with the current designs. Accordingly, there still remains a need for a superior lighting system featuring improved work area illumination and flexibility of use and increased efficiency in energy consumption.

SUMMARY OF THE INVENTION

The invention features three main components in a reconfigurable modular ambient lighting system. These components include an interchangeable light fixture body module, an interchangeable power module, and a support module. This invention allows maximum flexibility for reconfiguration and lighting options with an interchangeable inventory of modular components.

The light fixture body module permits the building owner, occupants, and/or individual workers to choose a lighting instrument that best suits their needs, today or in the future, by easily changing the light fixture body module without changing the support module or the power module. The light fixture body module is available in a plurality of architectural styles of various lengths, various shapes, and various lamping options. Many modular lamps of each type are available in a variety of output wattages, shapes, types, and sizes, and can, for certain applications, incorporate color variations.

The light fixture body module is connected electrically by wiring between the light fixture body module and the support module according to acceptable industry standards. The light fixture body module attaches mechanically to the support module with a plurality of structural supports. These supports are available in a variety of lengths, shapes, and materials designed to offer necessary suspension distances for optical performance, architectural appeal, and different electrical wiring variations.

The power module provides a central mounting location for electrical devices that operate and control the illumination of the light fixture body module. This power module is preferably designed to install quickly into the support module, but it can also be incorporated into a light fixture body module or a self-contained housing located between the support module and the light fixture body module. The power module contains electrical components such as transformers, ballast, emergency back-up systems and batteries, and special circuit controls, which can operate one or more light fixture body modules.

The invention supports flexibility to the user by allowing the independent change of the power module without changing the support module or light fixture body module, thus enabling changes to the operating mode of the light fixture body module by simply swapping the installed power module for a different power module.

The support module performs two primary functions. The first function is to provide a receptacle for the building's input electrical supply and conversion to an internal wiring system for the power module using wiring methods acceptable to the industry. The second function is to provide the mechanical, structural support for the power module and light fixture body module. The support module is available in a variety of sizes to fit any ceiling grid found in modern buildings using either English or metric measurements and may be used independent of a grid system in buildings lacking a ceiling grid system. The support module can also be used as a retrofit device for existing ceilings, offering ease of relocation equal to recessed fixtures currently found in modern buildings.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

Figure 1:
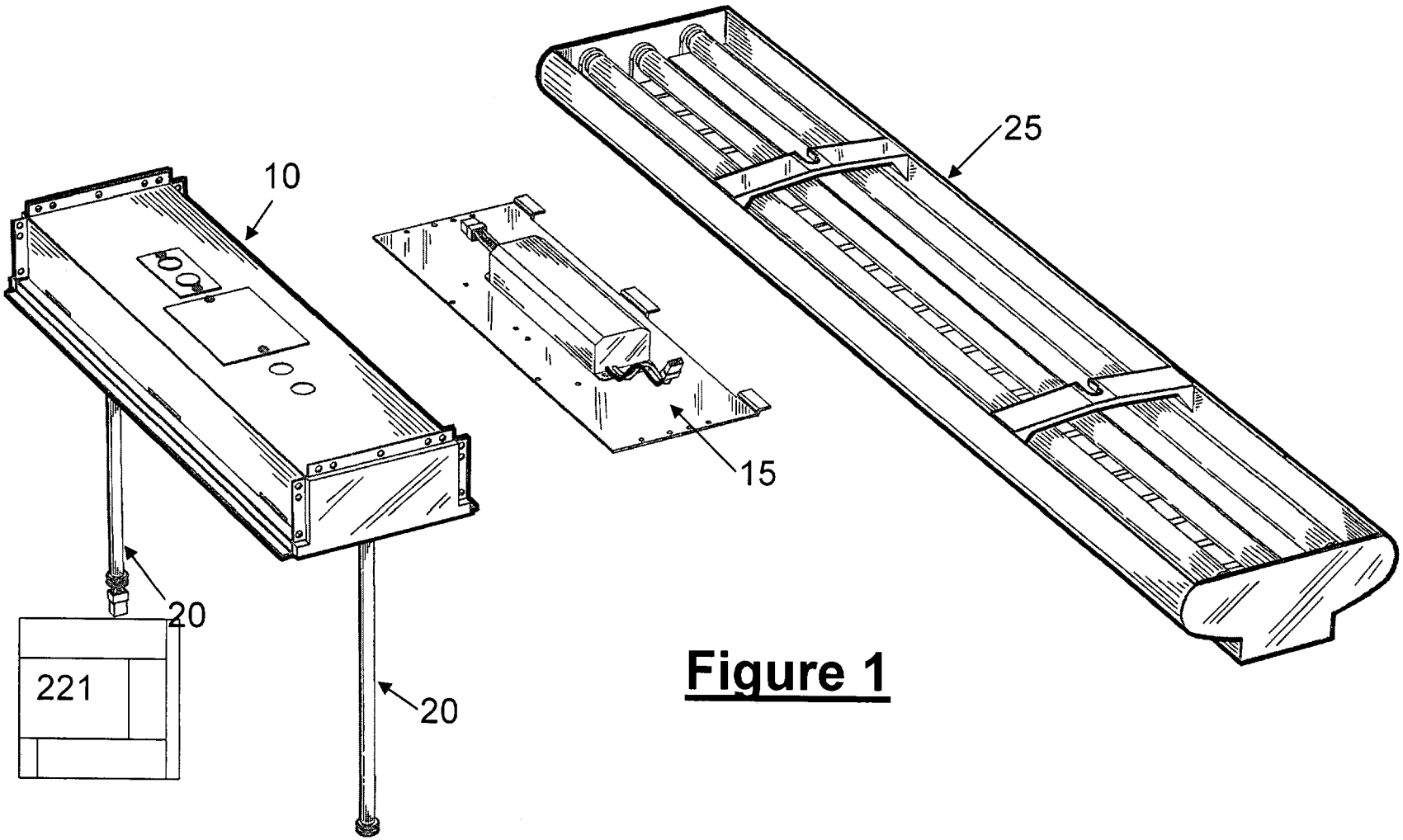
FIG. 1 is an overall view of the three components of the lighting system.

Referring to FIG. 1, the components of the invention include three basic modules. A support module 10 is the core structural component of the invention. Electrical connections to building power and the physical support infrastructure for the lighting system are all contained in this module. An interchangeable power module 15 fits into a matching recess or "foot print" in the bottom of the support module 10. The electrical components and circuitry for the light system are located on the power module 15. Pluralities of interchangeable power modules 15 are available in the invention that fit into the recess of the support module 10. Under certain circumstances, up to four power modules 15 may be mounted into corresponding recesses of a given support module 10.

Supports 20 connect to the support module 10 to hang down from the support module 10 and suspend a light fixture body module 25. The ends of the supports 20 fit into a bracket in the support module 10 and a bracket in the light fixture body module 25. The supports 20 are hollow and electrical wiring runs through one of the supports 20 to provide electrical power from the power module 15 to the lamps in the light fixture body module 25. The electrical connections found in the system feature industry acceptable electrical connectors for coupling the components together.

Figure 2:
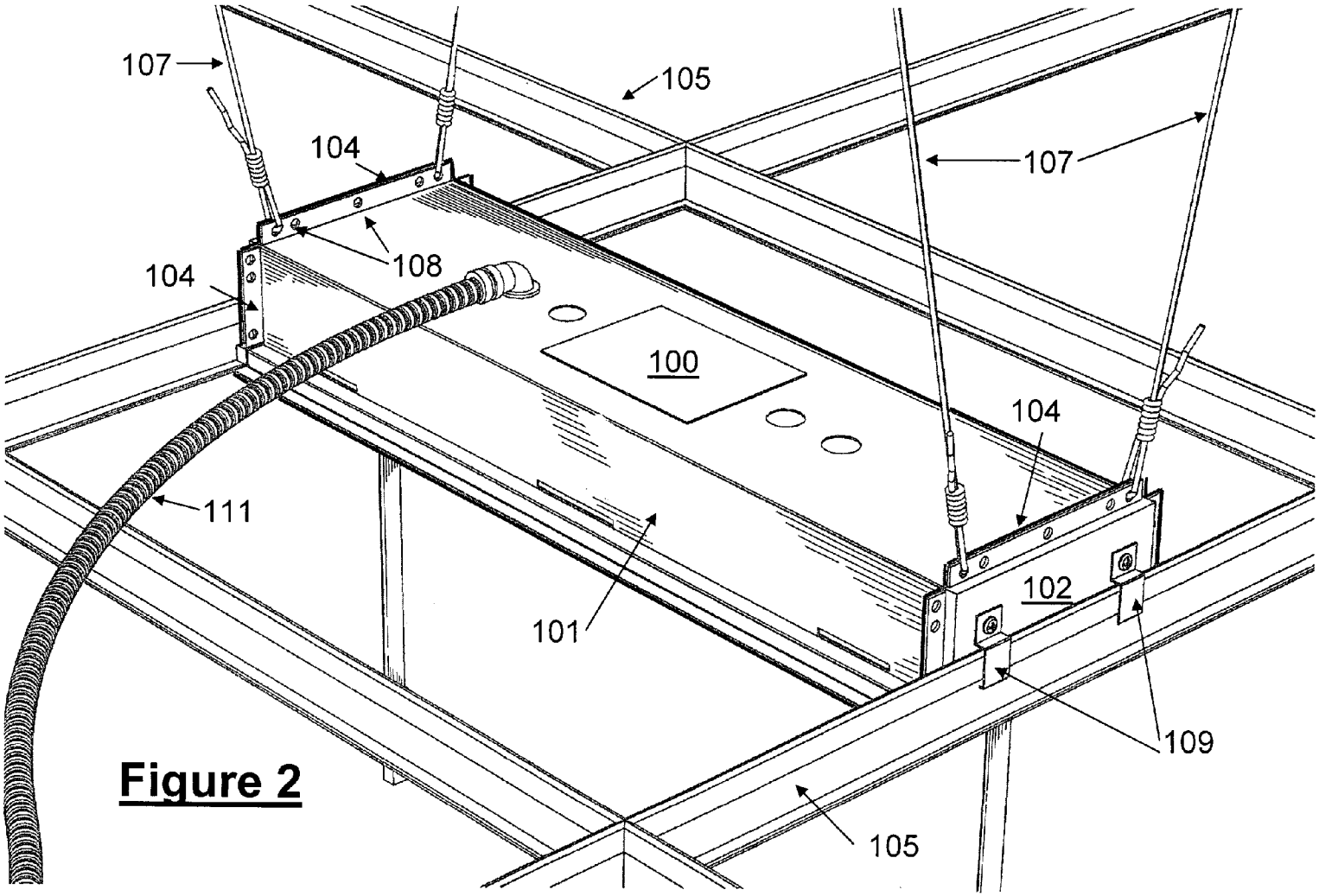
FIG. 2 is a view of the support module installed in the ceiling grid.

FIG. 2 shows the support module 100 installed in the ceiling grid 105. The support module 100 is a box-like structure with an open bottom sized to accept interchangeable power modules 15 (not shown). The support module 100 is constructed from a stamped sheet metal body 101 with end plates 102 at each end of the sheet metal body 101. The end plates 102 are over-sized with extended tab structures 104 extending from the top and sides of the sheet metal body 101. Other manufacturing techniques and materials may be used providing the same basic function.

The support module 100 can be sized to fit into any size ceiling grid layout with no modifications to the ceiling grid 105. The support module 100 can be mounted in other ceilings lacking a structured ceiling grid (like grid 105) such as a concealed spline or a gypsum-board ceiling. Accordingly, the support module 100 can be suspended downward from a building structure in buildings lacking formal ceiling construction.

Ceiling grids 105 are generally constructed in a grid pattern typically of metal in the form of inverted T-bar cross-sections. The support module 100 is sized to sit on the inverted T-bar of the ceiling grid 105. To comply with certain local building codes, the support module 100 may be placed into the ceiling grid 105 to install the lighting system. However, in many locales, sitting the support module 100 into the ceiling grid 105 without additional attachments is insufficient to comply with local building codes. In those areas, the support module 100 must also be secured to the building using supplemental attachments such as support wires 107, or similar structures, which are secured to mounting holes 108 located in the extended tab structure 104. Additionally, supplemental attachment of the support module 100 may include clips 109 on the end plates 102 to anchor the support module 100 to the ceiling grid 105.

The support module 100 can be made from metals, plastics, or other rigid materials, either manmade or natural. Flexible conduit 111 contains electrical wiring connections to the building's power, and this electrical wiring uses industry acceptable electrical connections. Preferably, this wiring will include plug-in connectors.

Figures 2A, 2B, 2C:
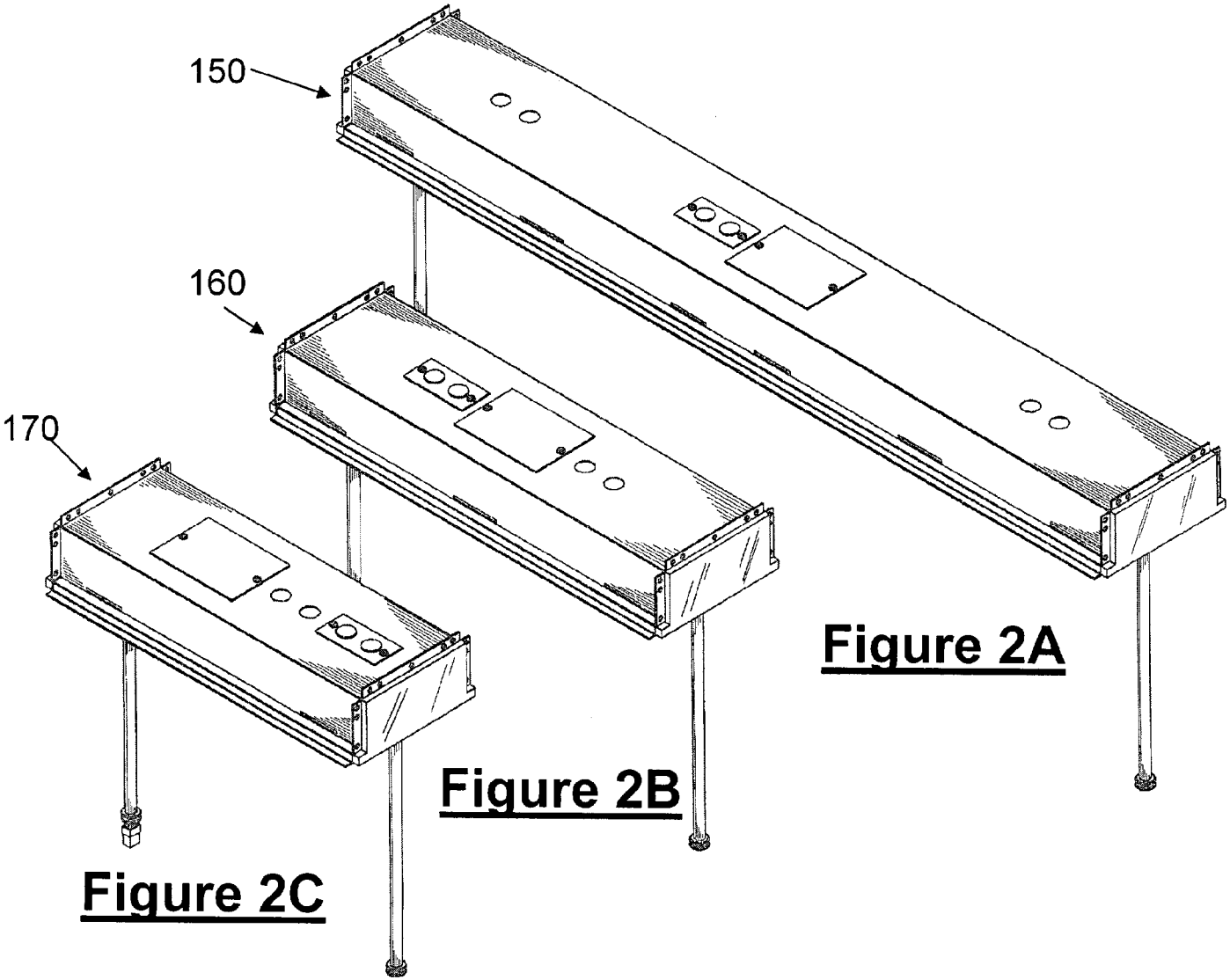
FIG. 2A is an embodiment for a 48-inch long support module.
FIG. 2B is an embodiment for a 24-inch long support module.
FIG. 2C is an embodiment for a 20-inch long support module.

FIGS. 2A, 2B, and 2C show several variable sizes for the support module. FIG. 2A is an embodiment for a 48-inch long support module 150. The 48-inch long support module 150 can incorporate up to four power modules and could, theoretically, support two linked light fixture body module bodies, each of which are connected to and powered by a separate pair of power modules. Each power module can provide the required electrical circuitry options such as emergency power, sensors, or other special features for the fixtures located under the support module.

FIG. 2B is an embodiment for a 24-inch long support module 160. The 24-inch long support module 160 can incorporate up to three power modules to provide required electrical circuitry. As with the support module 150, specialized electrical options may be used in support module 160. FIG. 2C is an embodiment for a 20-inch support module 170, and the 20-inch support module 170 can incorporate up to two power modules, each of which may feature different electrical circuitry options. These 48-inch, 24-inch, or 20-inch long support modules, or their metric equivalents, will support a variety of electrical circuitry and lighting options.

Figure 3:
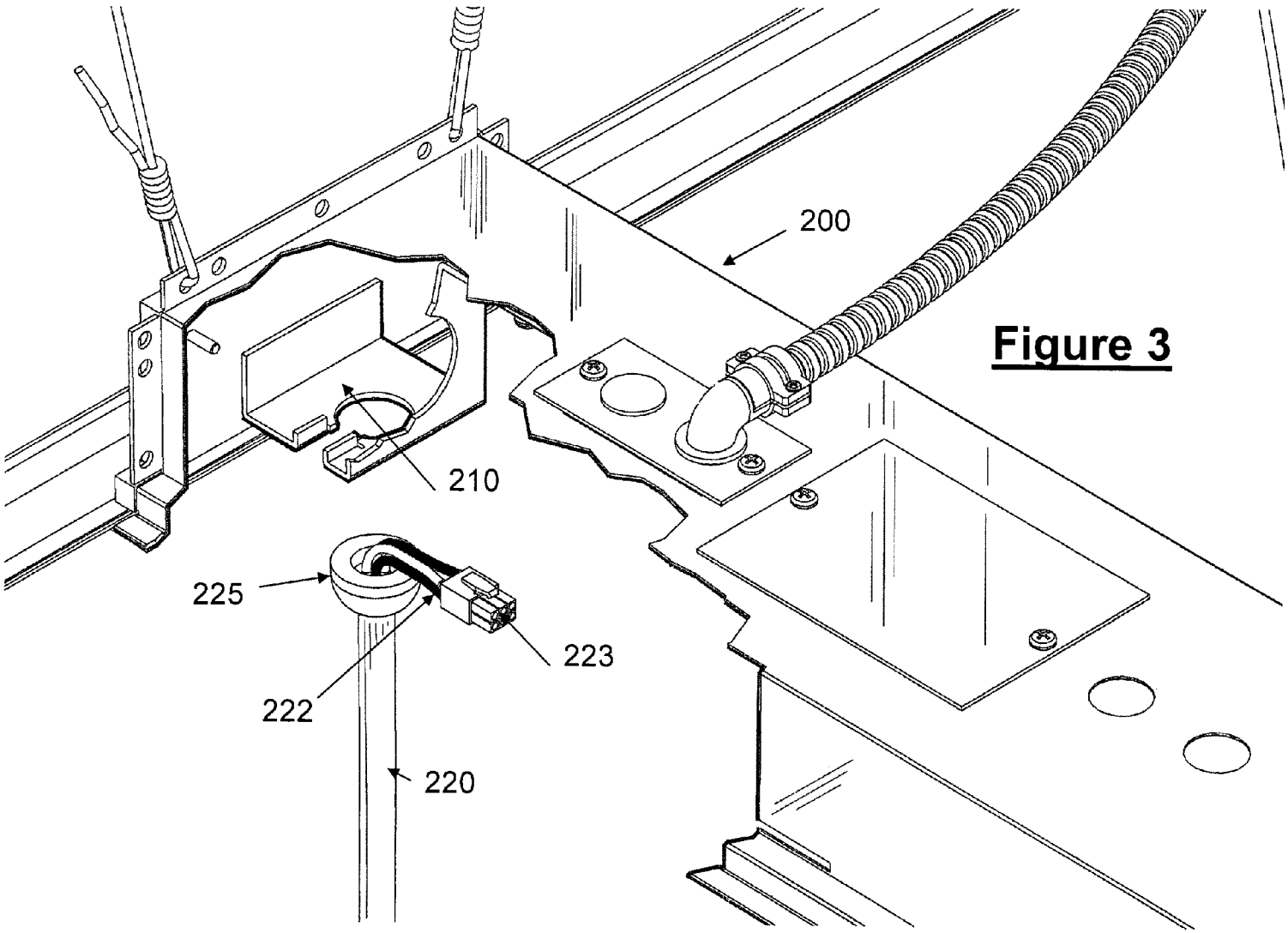
FIG. 3 is a cut-away view of the support module.

FIG. 3 shows a cut-away view of the support module 200. The support module 200 includes a support bracket 210 as the structural connector attaching the support 220 to the support module 200. The support bracket 210 accepts the support 220 hanging down from the bottom of the support module 200 to connect to the light fixture body module 25 (not shown). The support 220 terminates in a hemispherical-shaped connector 225 that fits into the support brackets 210. Many different types and shapes of connectors can be used with the invention.

In the preferred embodiment, the support 220 is hollow so that electrical wiring 222 can be routed through the support 220. The electrical wiring 222 connects the electrical power supplied by the support module 200 using connector 223. The support 220 may be constructed from metals, plastics, or other materials, either manmade or natural, and can be flexible or rigid. Alternatively, the support 220 may also be braided cable, and the electrical wiring connections can be completely separate from the supports 220 to connect power to the light fixture body module 25 (not shown).

Figure 4:
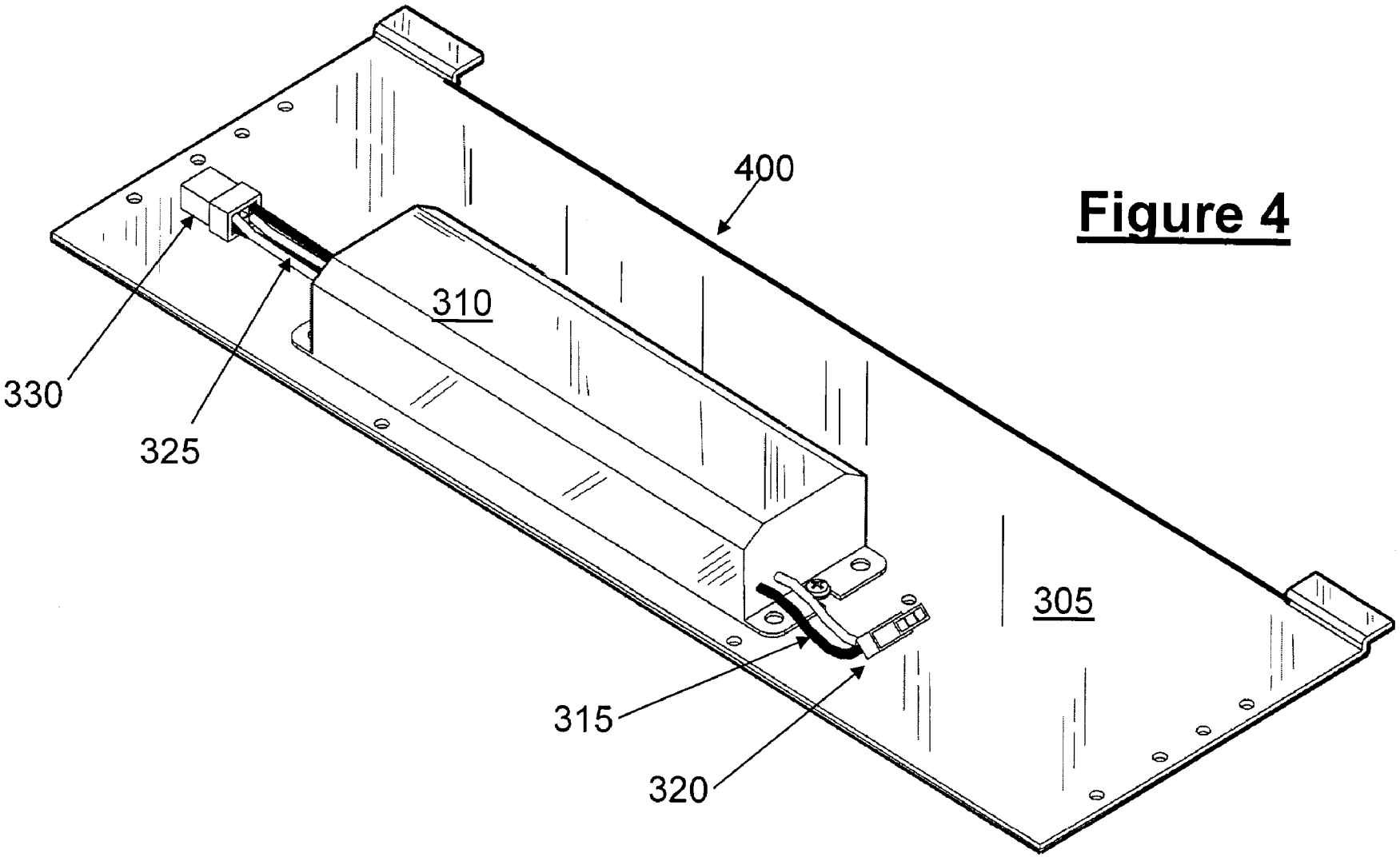
FIG. 4 is a view of the power module.

FIG. 4 shows an example power module 400. The power module 400 is composed of a base-plate 305 with electrical component 310 mounted to the base-plate 305. The base-plate 305 installs inside an opening in the bottom of the support module 200, which includes the "foot print" opening or recess in the support module 200. Alternatively, the power module 400 can be suspended from the support module between the support module and the light fixture body module. The power module 400 can even be mounted directly to the light fixture body module between the light fixture body module and the support module.

The electrical component 310 includes various electrical components and controls of the light system. These electrical components can include transformers, ballast, emergency back-up ballast, batteries, test switches, indicator switches or lights, heat sinks, fuses, circuit breakers, or control circuits (e.g. illumination sensors, occupant sensors, dimming ballast, dimming ballast controls, etc). Other special electrical components can be included as decided by the manufacturer or purchaser.

The component 310 can perform a number of functions. Transformers and ballast can adjust the input electrical voltage (e.g. building power) to the voltage required to power the lamp fixtures. Illumination sensors can adjust the lighting intensity for various external lighting conditions (e.g. bright sunlight or night) to maintain a constant illumination intensity. Occupant sensors can automatically sense the presence of people in the work area to turn on or turn off the light system. Dimming ballast and dimming ballast controls can adjust the intensity of illumination.

Emergency back-up ballast and batteries in the component 310 can provide emergency back-up power to provide illumination during power failures or failure of the main ballast. Test switches can be included in the component 310 to provide a means of testing the components of the light system, and installed indicator switches and lights visually display operation or settings for the light system. Heat sinks can be included to help dissipate heat generated in the power module 400. Fuses and circuit breakers can activate to shut off power in the event of excessive current flow to the light fixture. Although a single component 310 is shown, multiple components 310 may be mounted on a given base-plate 305.

Power from the building connects to the power module 400 using an electrical connector 320, preferably a plug-in electrical connector. Electrical wiring 315 leading to the component 310 supplies power to the component 310. Electrical wiring 325 and electrical connector 330 connect the power module 400 to the remaining components of the lighting system (e.g. the light fixture body module).

Figure 5:
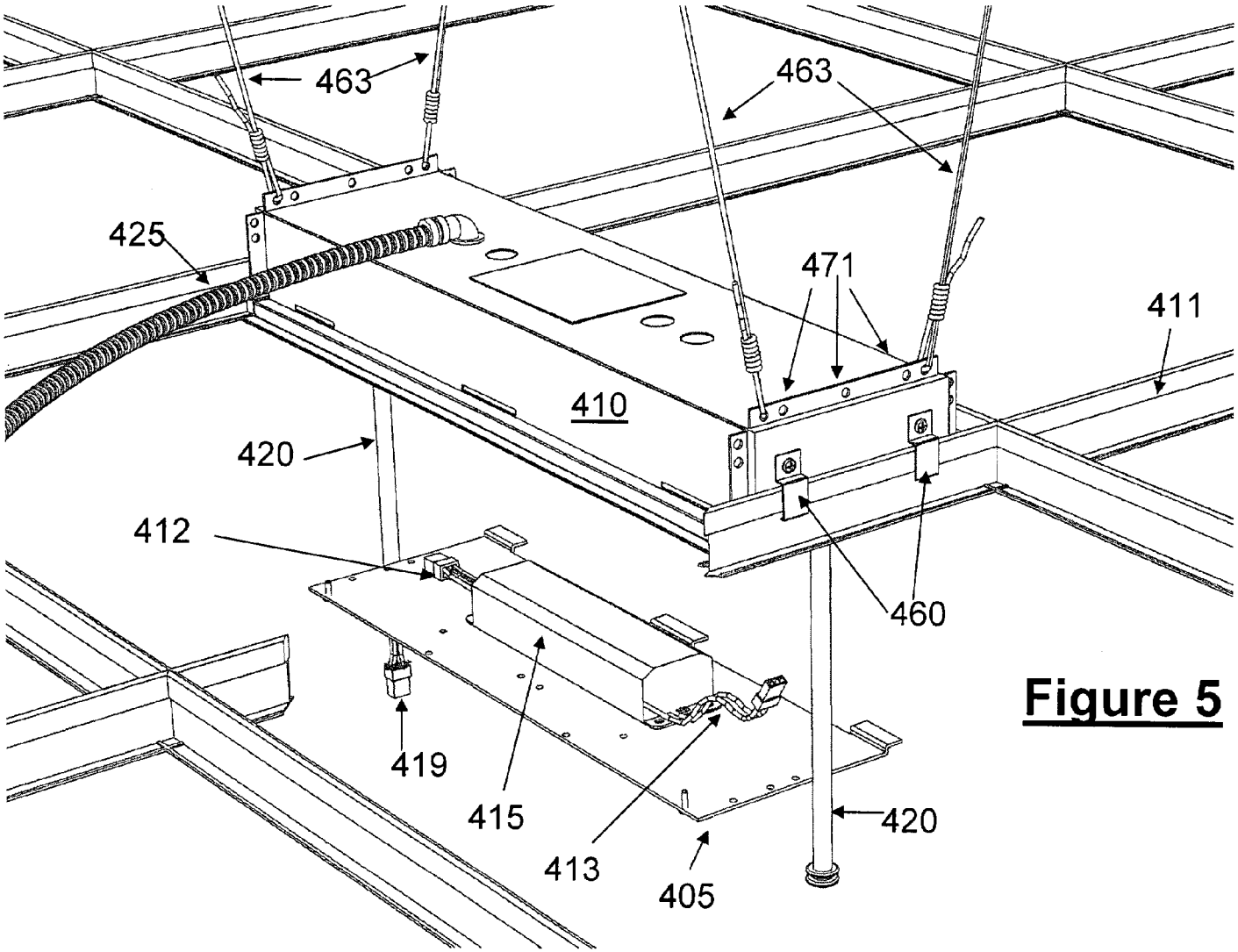
FIG. 5 shows a cut-away view of the support module and details on the interface of the power module and the support module.

FIG. 5 shows greater detail of the interface of the power module 405 and the support module 410. The power module 405 fits into the bottom of the support module 410. A wiring assembly using electrical connector 412 extends from the electrical component 415 of the power module 405 and connects to another electrical connector at the end of the support 420 opposite from the electrical connector 419 shown. A second wiring assembly and electrical connector 413 extends from the electrical component 415 to connect to the building's electrical supply provided by the electrical conduit 425.

A unique feature of the interface between the power module 405 and the support module 410 is the interchangeability of the design. The system's various power modules 405 feature a common size for interchangeably connection to the support module 410 in a bottom recess.

The support module 410 fits into the ceiling grid 411 and is secured to the ceiling grid with clips 460. The installation may also be secured in the ceiling by support wires 463 attached to holes 471 on the support module 410. Flexible electrical conduit 425 provides electrical power from the building to the support module 410.

Figure 6:
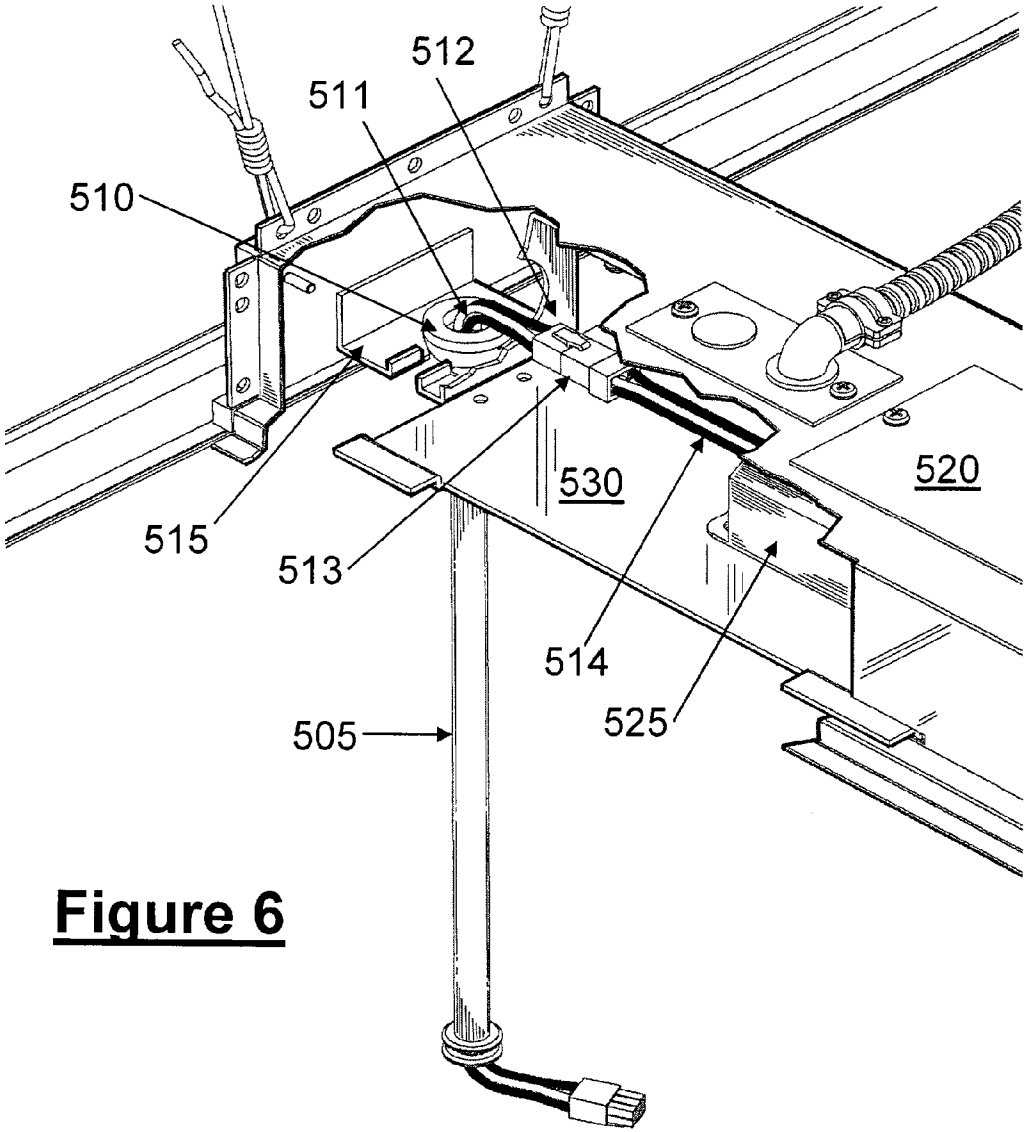
FIG. 6 shows a cut-away view of the support module with the power module installed and the interface of the supports, the attachment brackets, and the power module.

FIG. 6 shows a cut-away view of the support module 520 and the interface of the support 505 and the support module 520. The support 505 terminates at one end in a structural connector 510. The structural connector 510 fits down into the attachment bracket 515 of the support module 520. Running down and through the hollow structure of the support 505 is electrical wiring 511 with an industry acceptable electrical connector 512, which mates to a corresponding electrical connector 513 connecting electrical wiring 514 leading to the electrical component 525 of the power module 530. These two coupled electrical connectors 512 and 513 establish an electrical connection between the light fixture body module 25 (not shown) suspended at the lower end of the support 505 and the electrical component 525.

Figure 7:
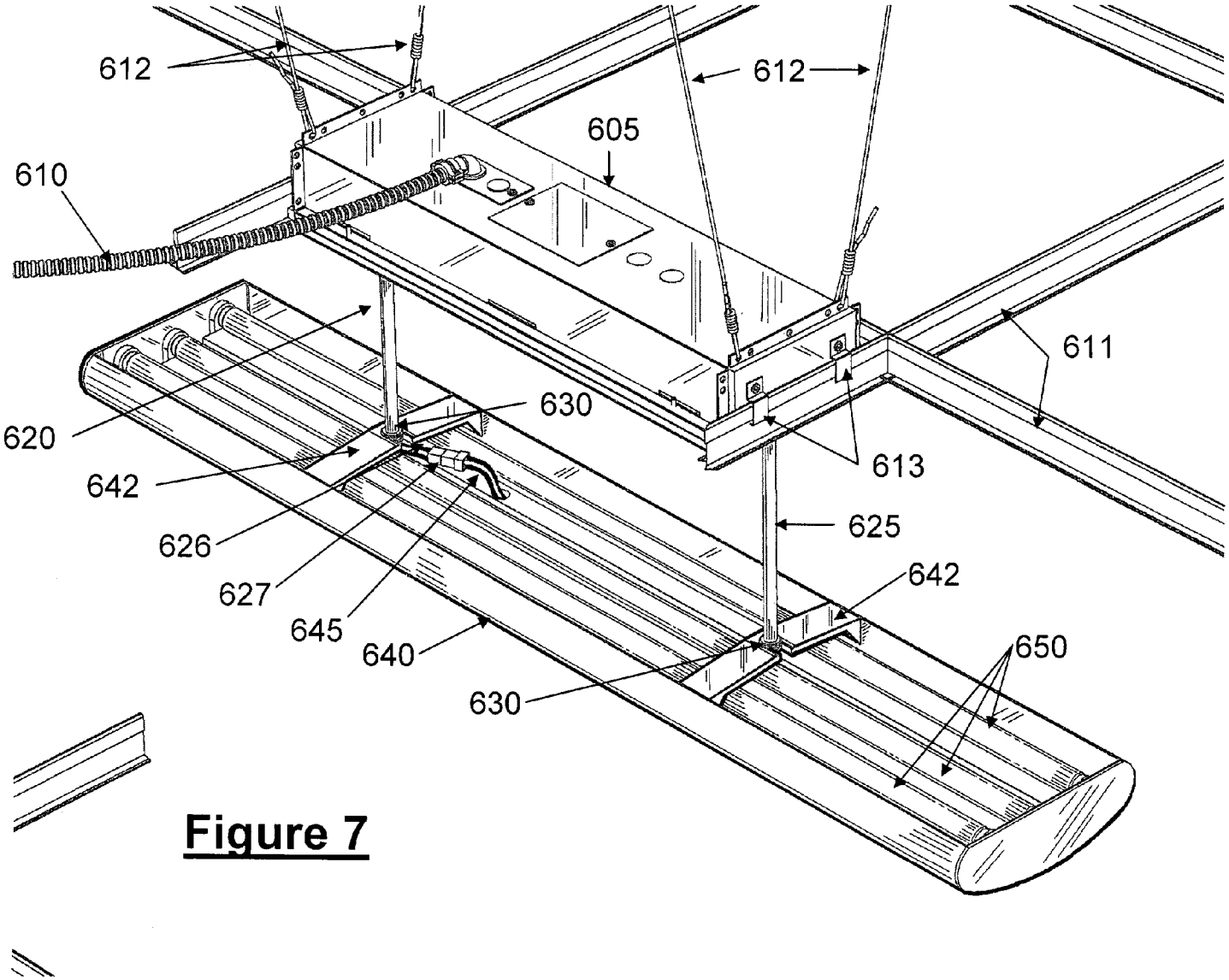
FIG. 7 shows how the light fixture body fixture module is suspended from the support module.

FIG. 7 shows how the light fixture body module 640 suspends from the rest of the system. The support module 605 connects to the building power supply using electrical conduit 610. The support module 605 fits into the ceiling grid 611 and can be secured in place using support wires 612 and/or clips 613. Two supports 620 and 625 are suspended from the bottom of the support module 605 using brackets (not shown) inside the support module 605. Each support 620 and 625 terminates at the light fixture body module 640 in a support fitting 630.

Preferably, at least one of the supports (e.g. support 620) also contains electrical wiring 626 with an electrical connector 627 for coupling to the internal electrical wiring 645 of the light fixture body module 640. The support fittings 630 fit into attachment brackets 642 in the top of the light fixture module 640, suspending the light fixture body module 640 from the bottom of the support module 605.

The light fixture body module 640 shown contains fluorescent lamps 650, but other lighting options may be installed including High Intensity Discharge (HID) lamps, incandescent lamps, or Light Emitting Diodes (LED) illumination devices. The illumination delivered by the light fixture body module 640 can be direct, indirect, or a combination (direct/indirect) as required or desired. The light fixture body module 640 can be constructed of metals, plastics, other rigid materials, either manmade or natural, or a combination of materials. Different light fixture body modules 640 in the invention can be in a variety of lengths, shapes, or sizes.

Figure 7C:
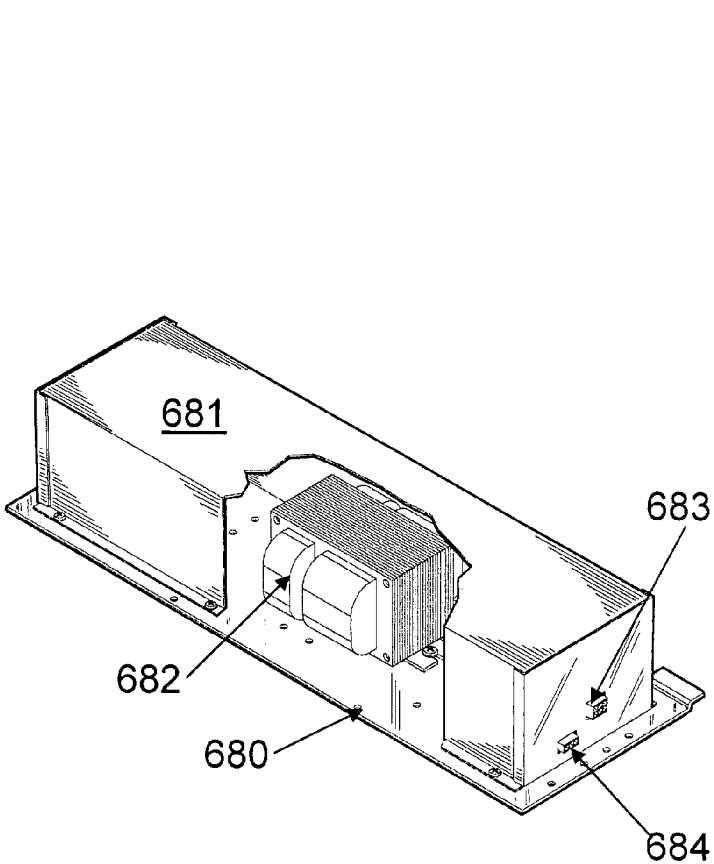
FIG. 7C is an embodiment for a power module compatible with high intensity device lamps.
Figure 7A:
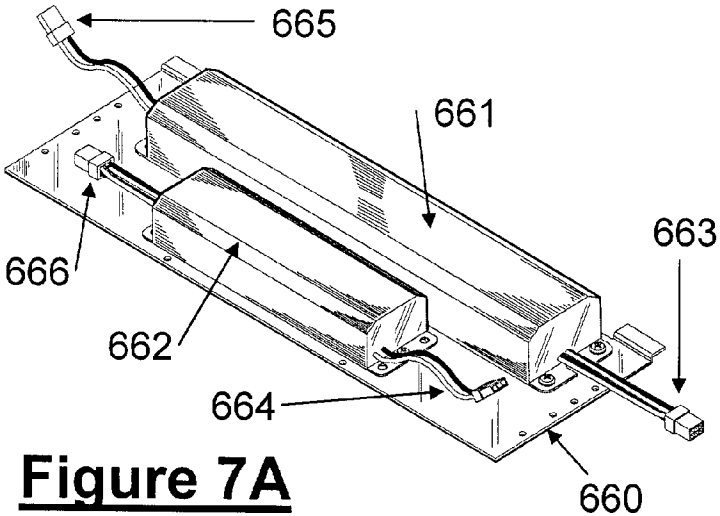
FIG. 7A is an embodiment for a power module compatible with fluorescent lamps.
Figure 7B:
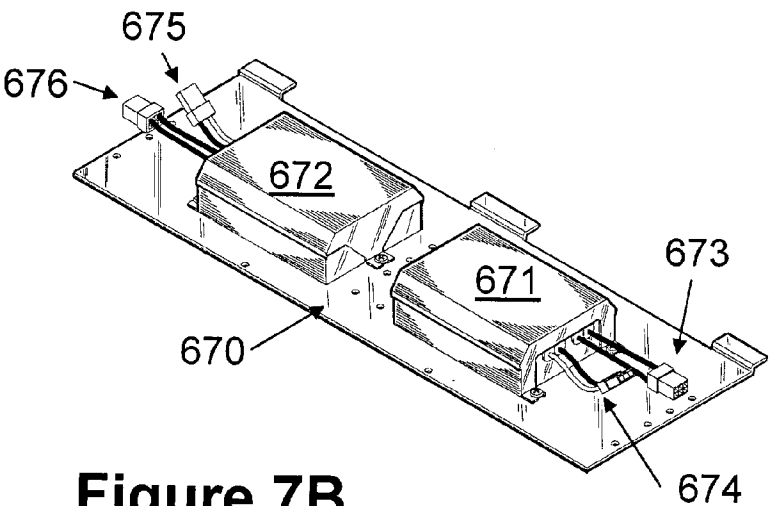
FIG. 7B is an embodiment for a power module compatible with light emitting diode illumination.

FIGS. 7A, 7B, and 7C show different embodiments of the power module that can be found in the invention. FIG. 7A depicts a power module 660 that features two electrical components 661 and 662 and is suitable for powering fluorescent lamps. The electrical component 662 has a ballast and/or related control circuits, and the electrical component 661 includes an emergency ballast for powering the light during a power failure and contains batteries and related electrical circuits. Plug-in electrical connectors 664 and 665 connect to the building power source, and plug-in electrical connectors 663 and 666 connect to corresponding electrical connectors connecting to the attached light fixture body.

FIG. 7B depicts a power module 670 that features two electrical components 671 and 672 compatible for use in powering LED illumination fixture. The electrical components 672 and 671 are transformers and/or related control circuits. Plug-in electrical connectors 674 and 675 connect to the building power source, and plug-in electrical connectors 673 and 676 connect to corresponding electrical connectors connecting to the attached light fixture body. In this embodiment, the two separate electrical components 672 and 671 provide power to two separate sets of LED illumination fixtures in a single light fixture body.

FIG. 7C depicts a power module 680 that features a single large electrical component 681, which includes a power transformer 682 and is compatible for powering HID and incandescent lamps. The electrical component 681 also includes any required and/or related control circuits and heat sinks. Plug-in electrical connectors 683 connect to the building power, and plug-in electrical connector 684 connects to the light fixture module.

Figure 8:
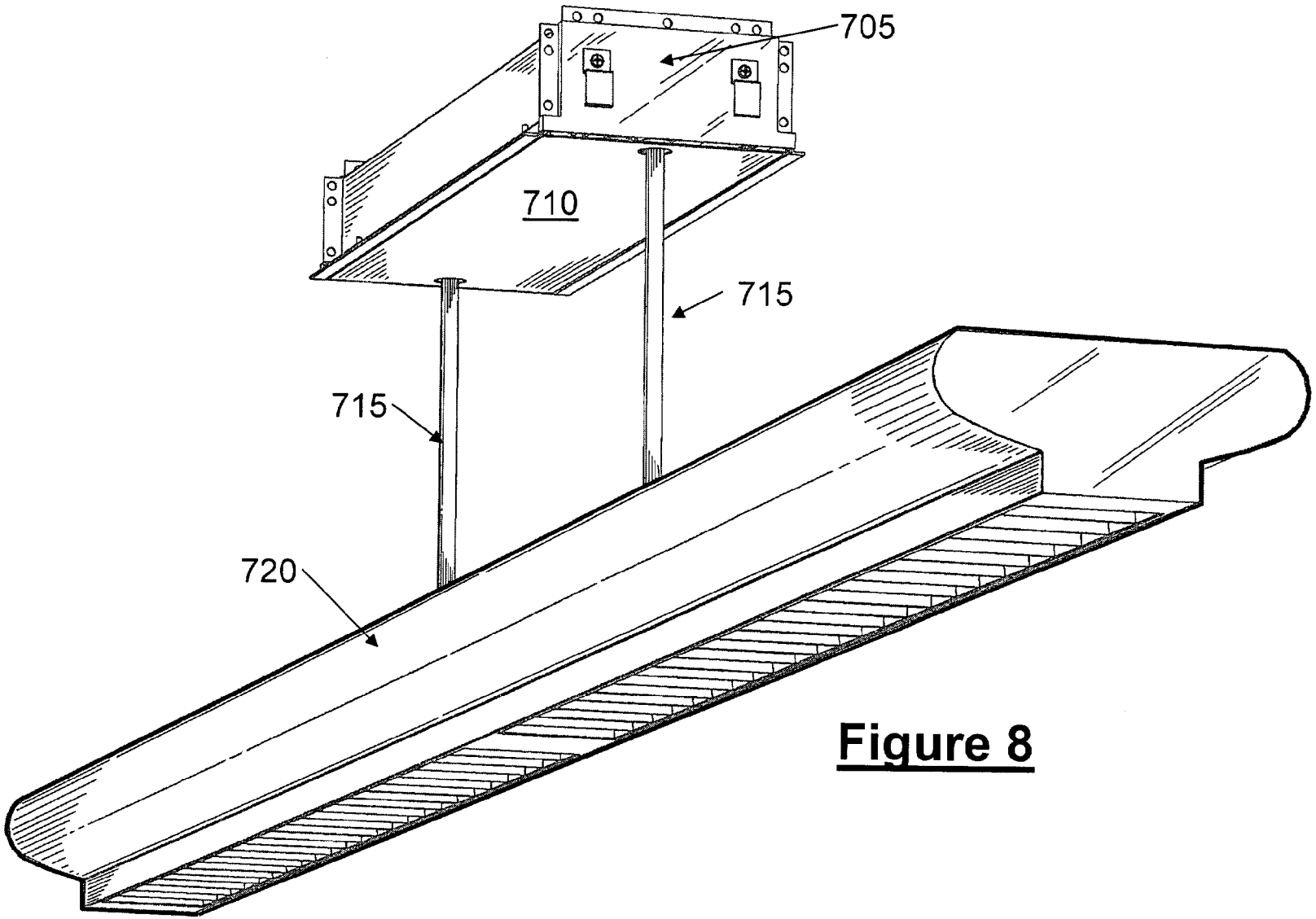
FIG. 8 shows the assembled light system modules.

FIG. 8 shows the completely assembled system. The support module 705 can be installed so that the power module 710 is located above the ceiling level or flush with the ceiling. The supports 715 hang down from the support module 705 to suspend the light fixture body module 720. The support module 705 and power module 710 can be made in a variety of different shapes and sizes to accommodate various ceiling grid specifications and dimensions. In the alternative, supports 715 can be extended to suspend the light fixture body module 720 down from a higher ceiling or building support structure. The supports 715 can generally be a variety of lengths and can include a variety of sizes and shapes. This support 715 can include a hinged, elongated rectangle shaped structure, cylindrical tubes, flexible conduit, stranded cable, woven cable or similar material, spun carbon fiber or other man-made materials, and rectangular tubes, or solid variations of these configurations.

Figure 9A:
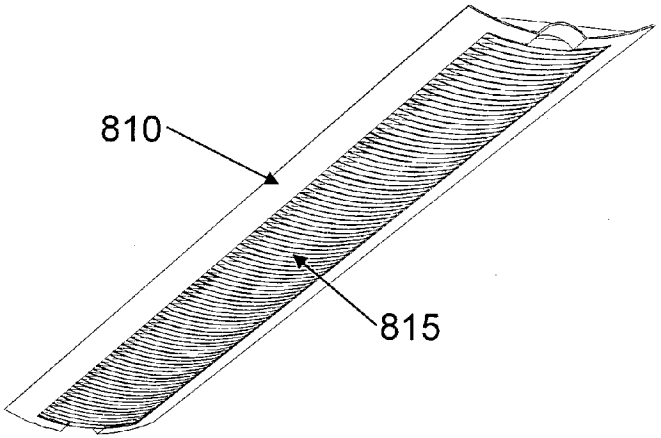
FIG. 9A shows an embodiment for a light fixture body module with direct lighting distribution using louvers.
Figure 9B:
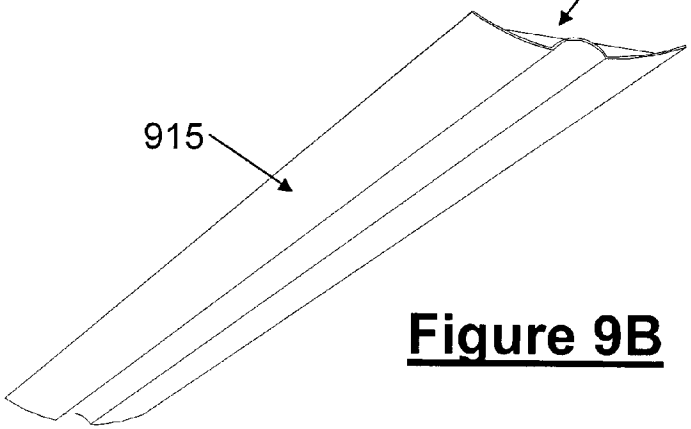
FIG. 9B shows an embodiment for a light fixture body module with indirect lighting distribution.
Figure 9C:
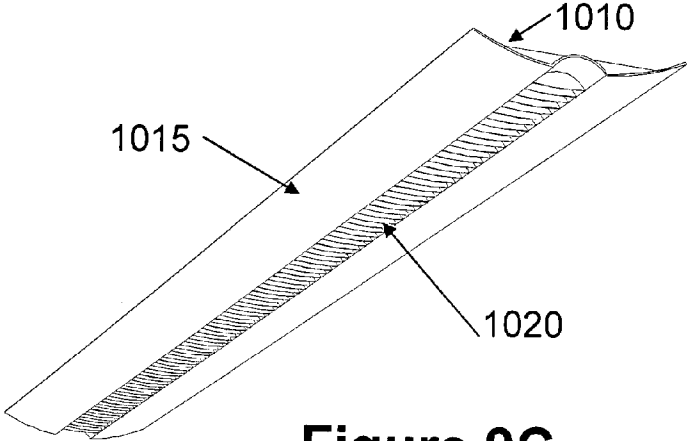
FIG. 9C shows an embodiment for a light fixture with both direct and indirect lighting distribution.

FIGS. 9A, 9B, and 9C depict several different light fixture body module embodiments for the invention. In FIG. 9A, the elongated light fixture body module 810 features a direct lighting distribution with numerous open louvers 815 for directing light into the space below. The light directed by the louvers 815 can be reflected light from the inner upper surface of the light fixture body module 810 or directed downward directly from the internal lamps, and this type light fixture body module can deliver direct or direct/indirect lighting. FIG. 9B features an elongated light fixture body module 910 with a solid body 915 to deliver indirect lighting reflected from the ceiling into the lower space. FIG. 9C features an elongated light fixture body module 1010. This light fixture body module 1010 includes both solid body 1015 and louvers 1020, and this type of light fixture body module 1010 can deliver a combination of direct/indirect lighting.

The suspension and electrical connectors of the modular design permit future modifications or renovations at lower costs compared to prior art designs because independent components may be changed to offer a variety of different optical, photometric, or style solutions, by simply swapping out the light fixture body module for another from a plurality of light fixture body modules. The plurality of light fixture body modules exhibits architectural differences such as variations in basic appearance, manufacturing materials (e.g. metals, plastics, and other rigid materials, either manmade or natural), or illumination distributions including direct, indirect, or combination direct/indirect illumination. Various lengths and shapes can be exhibited by the light fixture body module and include linear bodies of various lengths that are streamline, round, square, rectangular, or oval variations providing a variety of appearances and/or photometric variations or distributions, and may incorporate color variations in some applications.

The modular, interchangeable design of the support module and the power module offers considerable flexibility to the user for reconfiguring lighting systems. The support module and power module and associated electrical wiring can be left in place because of the modular design, and power modules can be easily changed independently, if required, without rewiring electrical connections or replacing or disassembling light fixture body modules. The independent change of the power module without change to either the support module or the light fixture body module permits modifications to the operating mode of the light fixture body module. For example, reconfiguring a light fixture to separate switching of lamps contained in the light fixture body module can be achieved by simply swapping the power module, where previously the mode of operation was universal switching of the lamps.

Another advantage of the invention is using the support module as a rough-in system enabling contractors or owners to purchase this module, independently, well in advance of knowing what lamp source or fixture body module style or size they require. This is unique to the industry and allows much more freedom of choice through the present unique modular concept.

This invention can also lead to substantial energy savings. Considering the earlier example of a facility with 20,000 square feet of floor space and 160 employees, each modular ambient system of the invention could serve individual employees or groups of employees based on their specific needs. Utilizing the invention in this example facility would require 160 units (one per employee), with each unit requiring 117 watts of electricity to provide desired illumination—a reduction in required electricity from 27,800 watts to 18,700 watts. This reduced energy load would also reduce associated heat generation and required air conditioning for cooling.

While the invention has been particularly shown and described with respect to preferred embodiments, it will be readily understood that minor changes in the details of the invention may be made without departing from the spirit of the invention.

We claim:

1. A reconfigurable modular light system for a hanging light fixture used in the interior of a building comprising connecting components consisting of:

a support module attached to a building structure mechanically to support itself, the power module, extended structural connector/support, and light fixture body module and coupled to a building electrical power source by internal wiring separate from an interchangeable self-contained power module, said interchangeable self-contained power module coupled to the support module and having all electrical components integrated into the module for operational control of the lighting system, said electrical components coupled to the electrical power source in the support module by a first plug-in electrical connection;

a first extended structural connector/support having a first end coupled to the support module and a second end coupled to the light fixture body module so as to extend down below the support module and a ceiling;

an interchangeable light fixture body module suspended from the support module by the first structural connector/support to hang down below the support module and containing at least one lamp, said lamp powered by a second plug-in electrical connection to the power module; and a recess in the support module that a plurality of power modules plug into, wherein the plurality of power modules may be individually exchanged to effect the operating mode of the hanging light fixture without disassembly or removal of the light fixture body or support module.

2. The reconfigurable modular light system for a hanging light fixture used in the interior of a building of claim 1 wherein the electrical components of the power module include a sensor control.

3. The reconfigurable modular light system for a hanging light fixture used in the interior of a building of claim 1 wherein the electrical components of the power module include an emergency back-up circuit.

4. The reconfigurable modular light system for a hanging light fixture used in the interior of a building of claim 1 wherein the electrical components of the power module include a circuit interrupting device.

5. The reconfigurable modular light system for a hanging light fixture used in the interior of a building of claim 1 wherein the electrical components of the power module include a ballast.

6. The reconfigurable modular light system for a hanging light fixture used in the interior of a building of claim 1 wherein the electrical components of the power module include a transformer.

7. The reconfigurable modular light system for a hanging light fixture used in the interior of a building of claim 1 wherein the electrical components of the power module include a dimming control system.

8. The reconfigurable modular light system for a hanging light fixture used in the interior of a building of claim 1 wherein the electrical components of the power module include a battery.

9. The reconfigurable modular light system for a hanging light fixture used in the interior of a building of claim 1 wherein the electrical components of the power module include an illumination intensity sensor.

10. The reconfigurable modular light system for a hanging light fixture used in the interior of a building of claim 1 wherein the support module attaches to a ceiling grid.

11. The reconfigurable modular light system for a hanging light fixture used in the interior of a building of claim 1 wherein the support module attaches to a gypsum board ceiling.

12. The reconfigurable modular light system for a hanging light fixture used in the interior of a building of claim 1 wherein the support module attaches to a concealed spline ceiling.

13. The reconfigurable modular light system for a hanging light fixture used in the interior of a building of claim 1 wherein the electrical components of the power module include an indicator.

14. A method for illuminating a building interior using a reconfigurable modular light system for a suspended light fixture comprising the steps of:

providing a support module attached to a building structure that connects building electrical power to the light system and includes an extended structural connector/support to suspend a light fixture module that hangs down below the support module;

securing at least one of a plurality of separate self-contained interchangeable power modules, the power module containing all electrical components of the light system integrated into the power module and including a first plug-in electrical connection coupling said building electrical power to the power module, wherein the plurality of power modules may be individually exchanged to effect the operating mode of the hanging light fixture without disassembly or removal of the light fixture body module or support module;

providing an interchangeable light fixture body module hanging down from the support module containing at least one illumination source suspended from said support module by said extended structural connector/support, wherein the plurality of light fixture body modules may be individually exchanged to effect the illumination distribution or alter the appearance without disassembly or removal of the power module or the support module; and connecting said interchangeable light fixture body module to said power module using a second electrical connection to provide control of the illumination source.

15. The method for illuminating a building interior of claim 14 wherein the light fixture body module provides direct illumination.

16. The method for illuminating a building interior of claim 15 wherein the light fixture body module also provides indirect illumination.

17. The method for illuminating a building interior of claim 14 wherein the light fixture body module provides indirect illumination.

18. The method for illuminating a building interior of claim 14 wherein the structural support includes a metal cable.

19. The method for illuminating a building interior of claim 14 wherein the structural support is hollow for routing of electrical wiring.

20. A system for providing illumination to a building interior using a reconfigurable modular light system illuminating an area comprising:

a support module coupled to a building by a first structural connector, said support module providing a plug-in electrical interface to the building's electrical power and including at least one extended structural connector/support suspended from the support module to extend downward and hang from the support module;

one or more of a plurality of self-contained interchangeable power modules accessible without disassembly of the support module coupled to the support module by a second structural connector/support, said one or more power modules having an electrical component integrated into the power module to couple to the electrical power interface using a first plug-in electrical connector;

one or more interchangeable light fixture body modules suspended by said extended structural connector/support to hang below said support module, each interchangeable light fixture body module having one or more illumination sources coupled to said power module by a second plug-in electrical connector; and said power module and said light fixture body module able to be independently changed without disassembly or removal of any other module.

21. The system for providing illumination to a building interior using the reconfigurable modular light system of claim 20 wherein the one or more illumination sources comprises a fluorescent light source.

22. The system for providing illumination to a building interior using the reconfigurable modular light system of claim 20 wherein the one or more illumination sources comprises a high intensity device light source.

23. The system for providing illumination to a building interior using the reconfigurable modular light system of claim 20 wherein the one or more illumination sources comprises a light emitting diode light source.

24. The system for providing illumination to a building interior using the reconfigurable modular light system of claim 20 wherein the one or more illumination sources comprises an incandescent light source.

25. The system for providing illumination to a building interior using the reconfigurable modular light system of claim 20 wherein the illumination provided includes direct lighting.

26. The system for providing illumination to a building interior using the reconfigurable modular light system of claim 25 wherein the illumination provided includes indirect lighting.

27. The system for providing illumination to a building interior using the reconfigurable modular light system of claim 20 wherein the illumination provided includes indirect lighting.

* * * * *